US007226315B2

(12) United States Patent
Takeda et al.

(10) Patent No.: US 7,226,315 B2
(45) Date of Patent: Jun. 5, 2007

(54) ELECTRIC CONNECTOR HAVING A RECEIVING PORTION FOR RECEIVING PRYING FORCE WHEN THE CONNECTOR IS COUPLED TO A MATING CONNECTOR

(75) Inventors: Shinpei Takeda, Tokyo (JP); Hideyuki Ootani, Tokyo (JP); Kazutaka Okuzako, Hiroshima (JP)

(73) Assignees: Japan Aviation Electronics Industry, Limited, Tokyo (JP); Sharp Kabushiki Kaisya, Osaka-shi, Osaka (JP)

( * ) Notice: Subject to any disclaimer, the term of this patent is extended or adjusted under 35 U.S.C. 154(b) by 0 days.

(21) Appl. No.: 11/345,561

(22) Filed: Feb. 1, 2006

(65) Prior Publication Data

US 2006/0172592 A1 Aug. 3, 2006

(30) Foreign Application Priority Data

Feb. 1, 2005 (JP) ..... 2005-025696

(51) Int. Cl.
*H01R 13/60* (2006.01)

(52) U.S. Cl. ..... 439/607

(58) Field of Classification Search ..... 439/569, 439/573, 500, 607

See application file for complete search history.

(56) References Cited

U.S. PATENT DOCUMENTS 5,326,282 A 7/1994 Igarashi et al.
D434,383 S * 11/2000 Hu et al. ..... D13/147
6,354,870 B1 * 3/2002 Timmerman ..... 439/569
6,716,064 B2 * 4/2004 Kubo ..... 439/607
2003/0119347 A1 * 6/2003 Kubo ..... 439/100
2006/0216995 A1 * 9/2006 Ohki et al. ..... 439/607

FOREIGN PATENT DOCUMENTS

EP 0 793 303 9/1997
JP 9259981 10/1997

* cited by examiner

*Primary Examiner*—Neil Abrams
*Assistant Examiner*—Phuongchi Nguyen
(74) *Attorney, Agent, or Firm*—Collard & Roe, P.C.

(57) ABSTRACT

In an electric connector including a conductive shell fitting portion to be fitted to a mating connector, a receiving portion is arranged within the shell fitting portion to receive a load by plying force between the electric connector and the mating connector. It is preferable that a housing is coupled to the shell fitting portion and that a conductive contact is held by the housing. In this case, the receiving portion has a flat shape with its one end coupled to the housing and the other end coupled to the shell fitting portion. The receiving portion may be made of a metal material or a resin material.

10 Claims, 18 Drawing Sheets

ELECTRIC CONNECTOR HAVING A RECEIVING PORTION FOR RECEIVING PRYING FORCE WHEN THE CONNECTOR IS COUPLED TO A MATING CONNECTOR

CROSS REFERENCE TO RELATED APPLICATIONS

Applicant claims priority under 35 U.S.C. §119 of Japanese Applicant No. 2005-025696, filed Feb. 1, 2005.

This application claims priority to prior Japanese patent application JP 2005-25696, the disclosure of which is incorporated herein by reference.

BACKGROUND OF THE INVENTION

This invention relates to an electric connector having a shell to be fitted to a mating connector.

An electric connector having a conductive shell to be fitted to a mating conductive shell of a mating connector is known. Each of these shells is a pressed part formed by press-punching and bending a thin metal plate, and has a cylindrical shell fitting portion. The shell fitting portions are contacted and fitted to each other to be electrically connected (for example, see Japanese Unexamined Patent Application Publication No. H09-259981).

When the electric connector is fitted to the mating connector, i.e., when the shell fitting portions are contacted and fitted to each other, it is supposed that strong prying force is applied to the electric connector to expand the shell fitting portion of the electric connector by the principle of the lever. More particularly, since the prying force is received by the shell fitting portions alone, the shell fitting portions may possibly be deformed.

SUMMARY OF THE INVENTION

It is therefore an object of this invention to provide an electric connector which is effectively prevented from being deformed when the electric connector is fitted to a mating connector.

Other object of the present invention will become clear as the description proceeds.

According to an aspect of the present invention, there is provided an electric connector comprising a conductive shell fitting portion to be fitted to a mating connector and a receiving portion arranged within the shell fitting portion to receive a load by plying force between the electric connector and the mating connector.

Figure 1:
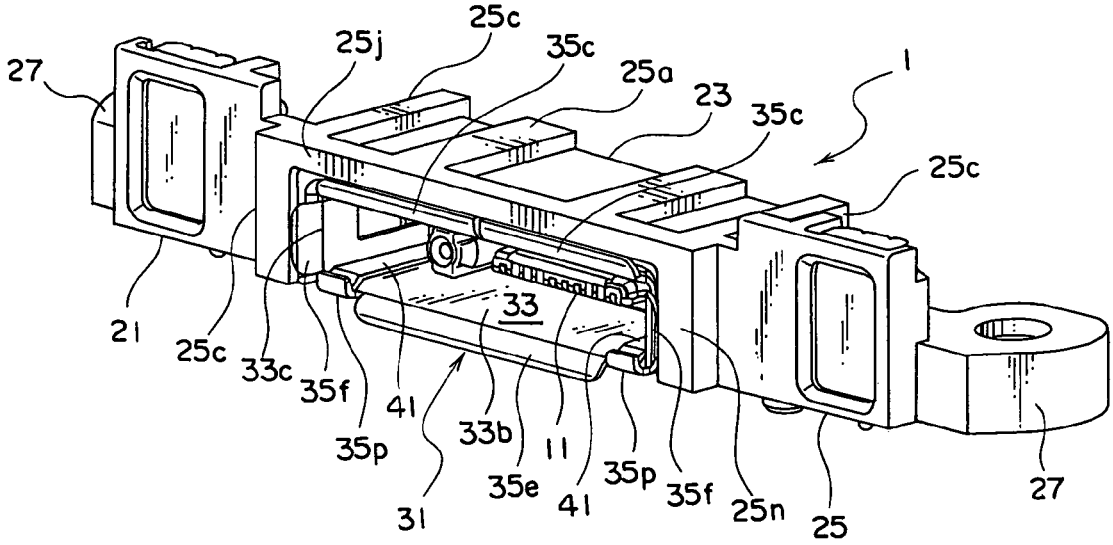
FIG. 1 is a perspective view of an electric connector according to a first embodiment of this invention.
Figure 2:
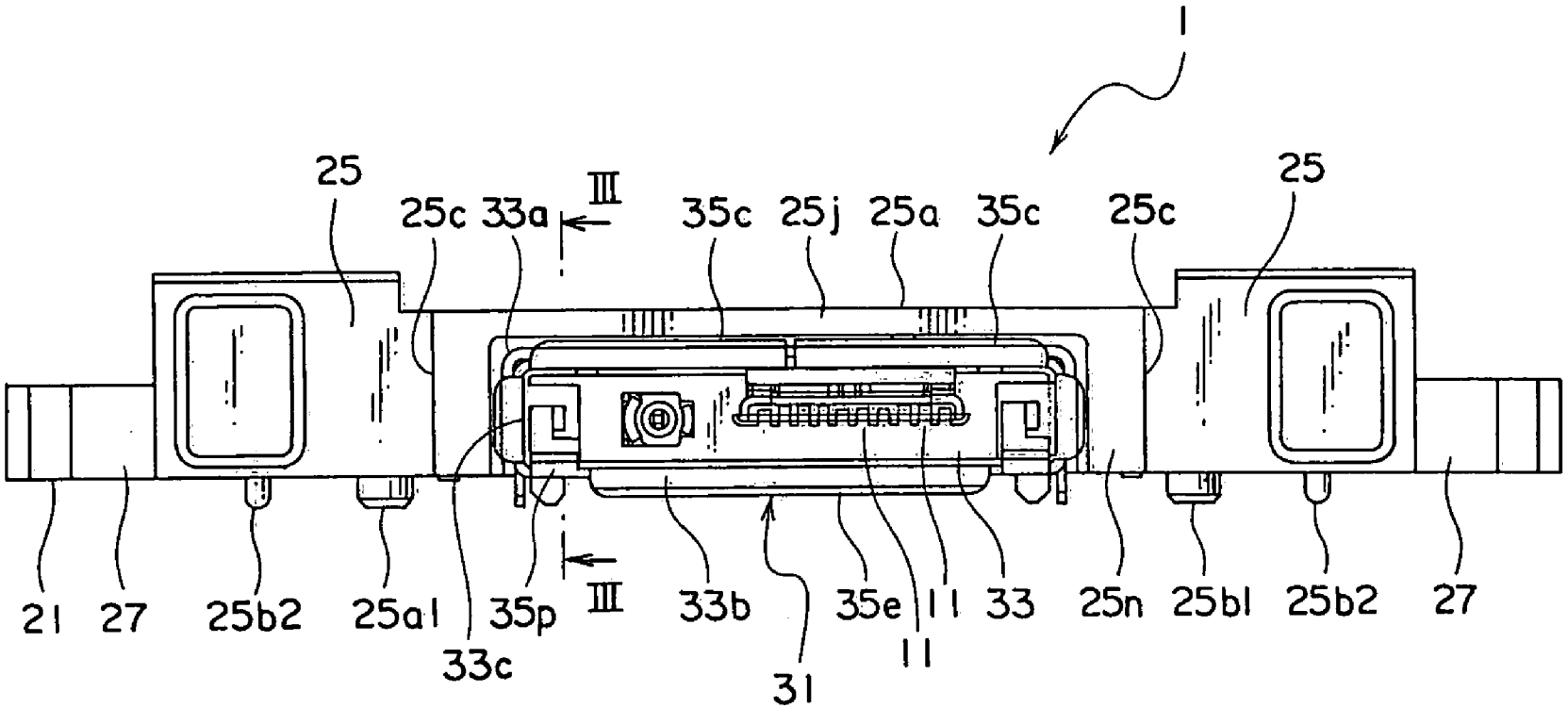
FIG. 2 is a front view of the electric connector illustrated in FIG. 1.
Figure 3:
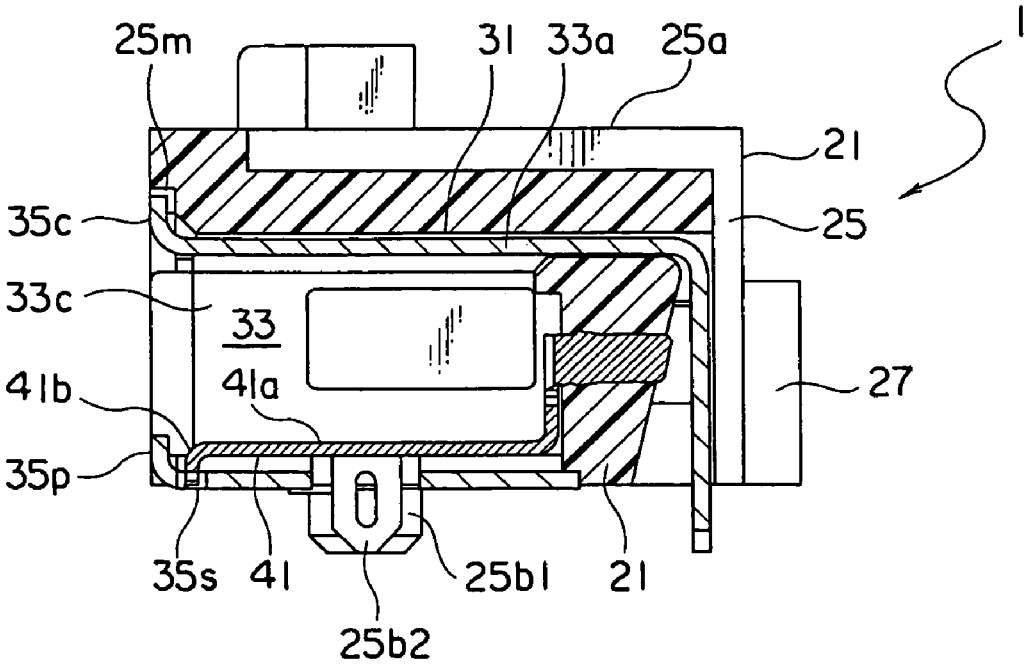
FIG. 3 is an enlarged sectional view taken along a line III—III in FIG. 2.
Figure 4:
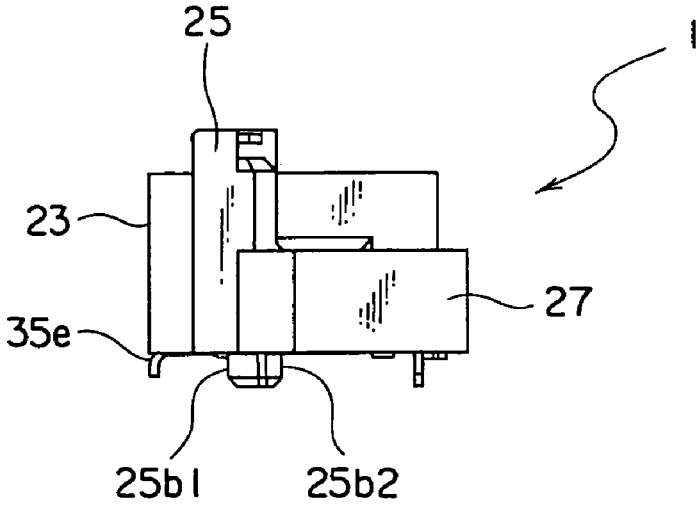
FIG. 4 is a right side view of the electric connector illustrated in FIG. 1.
Figure 5:
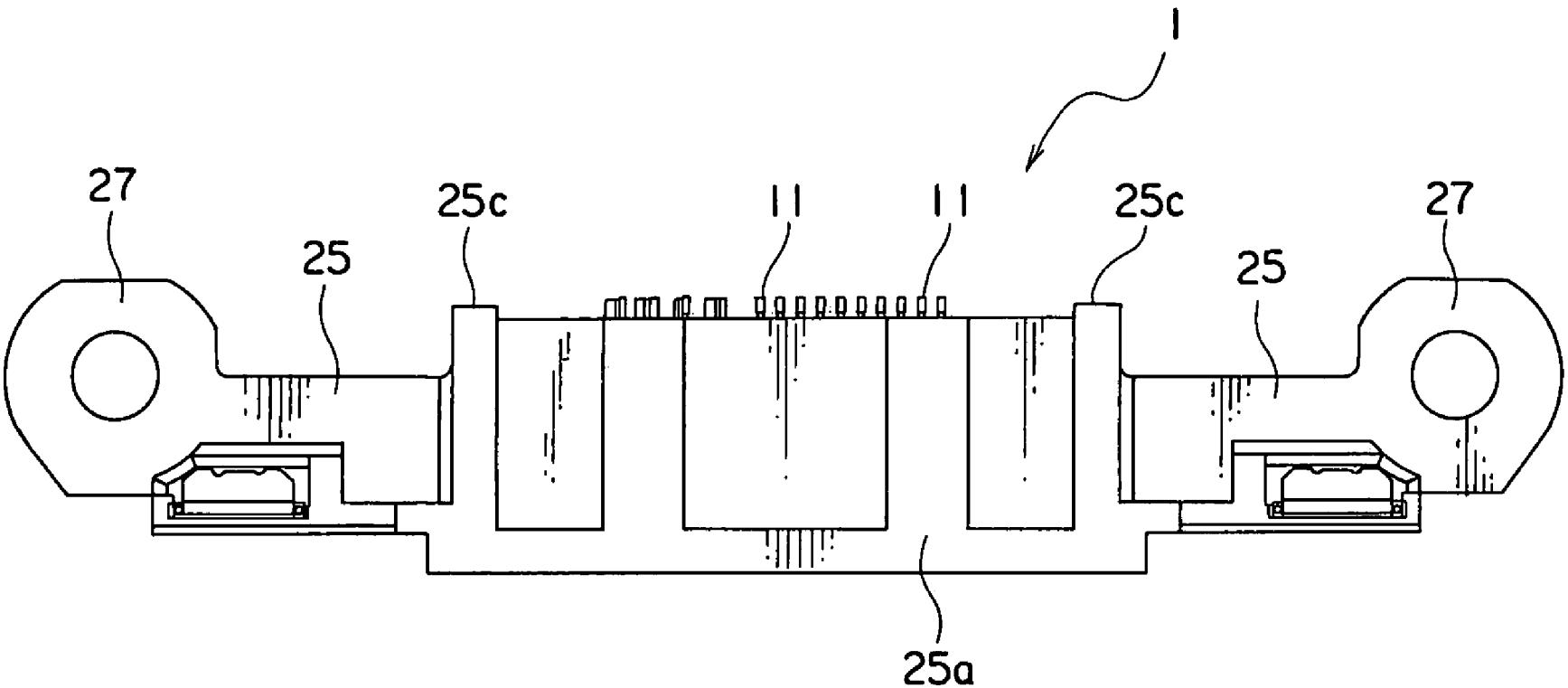
FIG. 5 is a plan view of the electric connector illustrated in FIG. 1.
Figure 6:
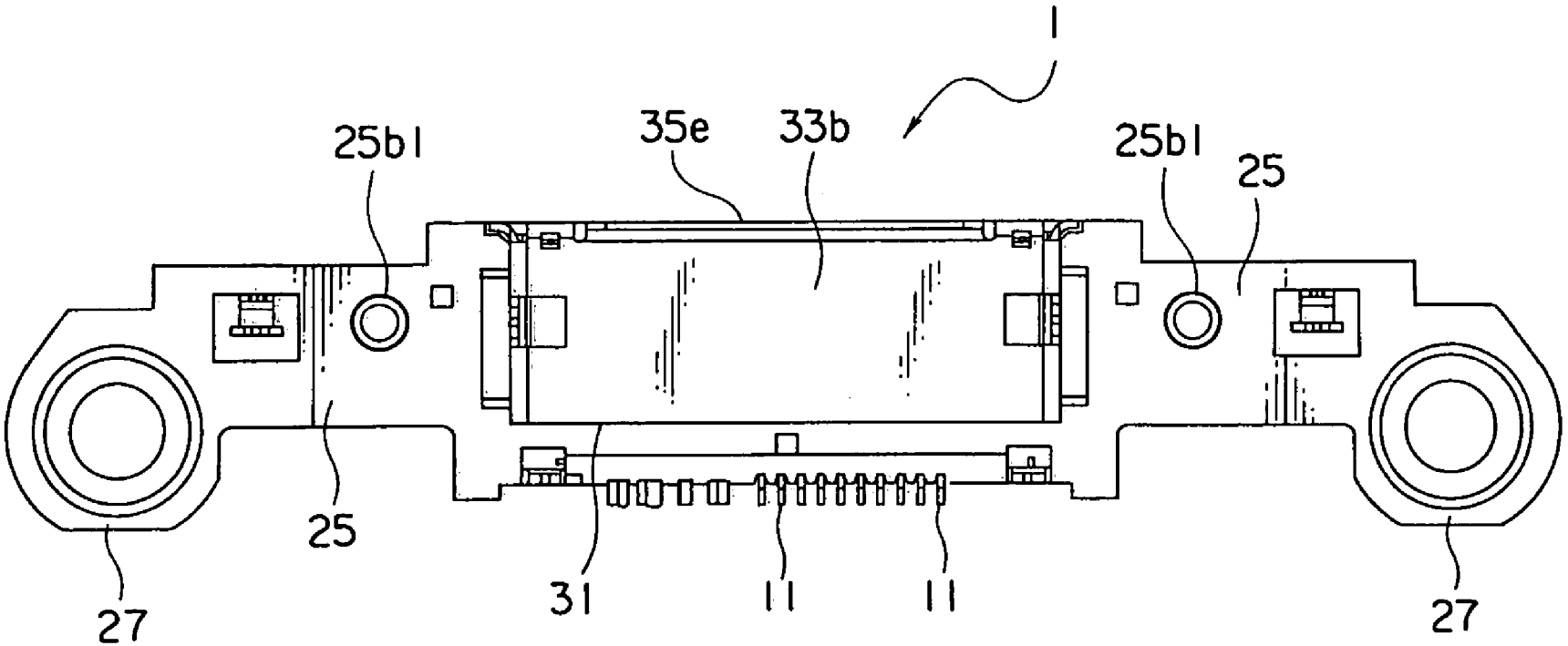
FIG. 6 is a bottom view of the electric connector illustrated in FIG. 1.

DESCRIPTION OF THE PREFERRED EMBODIMENTS:

Referring to FIGS. 1 to 6, description will be made of an electric connector according to a first embodiment of this invention.

In FIGS. 1 to 6, the electric connector depicted by a reference numeral 1 comprises a plurality of conductive contacts 11, an insulating housing 21 holding the contacts 11, a conductive shell 31, and a pair of receiving portions 41 fixed to the housing 21. The housing 21 has a holding portion 23 holding the shell 31, a pair of block portions 25 extending from opposite sides of the holding portion 23 in a longitudinal direction of the electric connector 1, respectively, and a pair of fixing portions 27 extending from the block portions 25 in the longitudinal direction, respectively. When the electric connector 1 is mounted to a substrate such as a printed circuit board, the fixing portions 27 serve to fix the electric connector 1 to the substrate via fastening members such as bolts.

The holding portion 23 has a main plate portion 25*a* extending long in the longitudinal direction of the electric connector 1 and a pair of wall portions 25*c* connected to longitudinal opposite ends of the main plate portion 25*a*, respectively, and faced to each other. The shell 31 has a generally flat and tubular or hollow shell fitting portion 33 which is disposed in a space surrounded by the main plate portion 25*a* and the wall portions 25*c* and which is held by the housing 21. The shell fitting portion 33 has a first shell plate portion 33*a* faced to an inner surface of the main plate portion 25*a*, a second shell plate portion 33*b* faced to and spaced from the first shell plate portion 33*a* generally in parallel thereto, and a pair of shell side plate portions 33*c* connected to longitudinal opposite ends of the first and the second shell plate portions 33*c*.

The shell 31 has a first guide portion 35*c* bent from a fitting-side or front opening end of the first shell plate portion 33*a* to face a recess 25*m* formed on an end face 25*j* of the main plate portion 25*a* of the holding portion 23, a second guide portion 35*e* bent outward from a fitting-side opening end of the second shell plate portion 33*b*, and a pair of third guide portions 35*f* bent outward to face the wall portions 25*c* of the holding portion 23, respectively.

Figure 7:
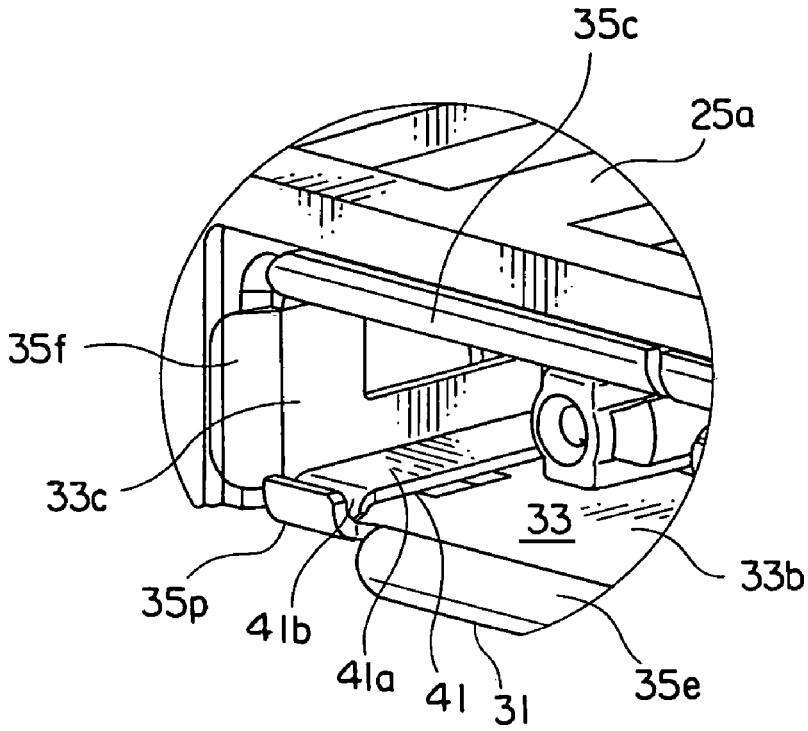
FIG. 7 is an enlarged view of a characteristic part in FIG. 1.
Figure 8:
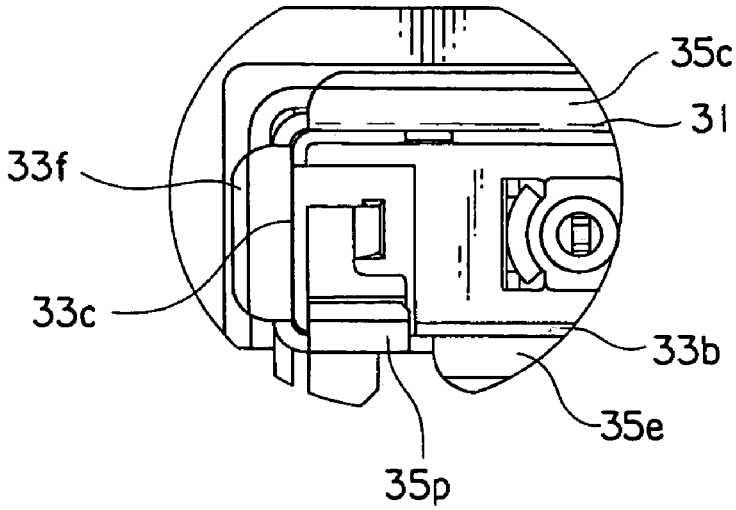
FIG. 8 is an enlarged view of a characteristic part in FIG. 2.
Figure 9:
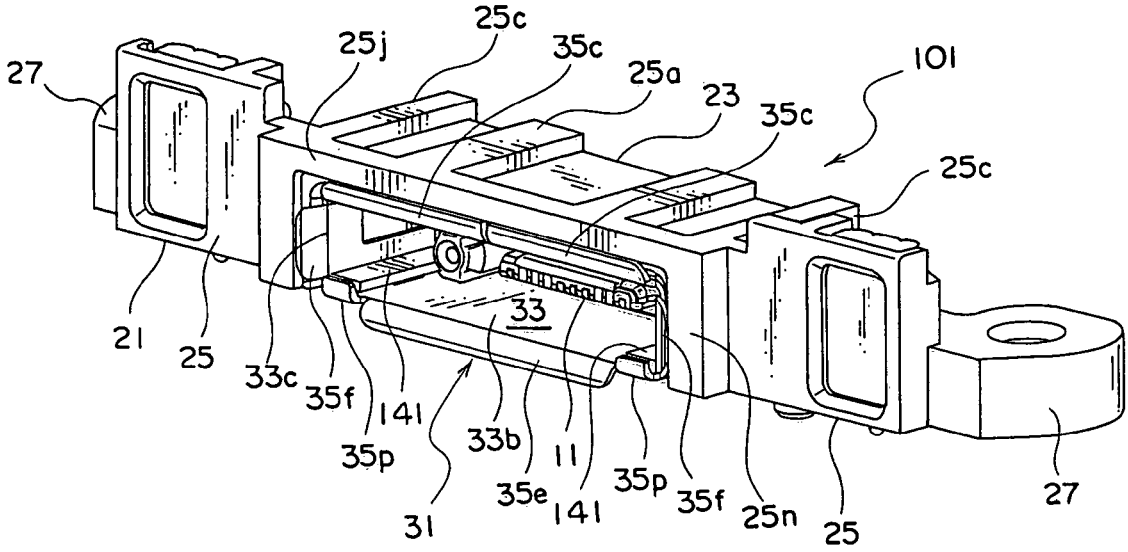
FIG. 9 is a perspective view of an electric connector according to a second embodiment of this invention.
Figure 10:
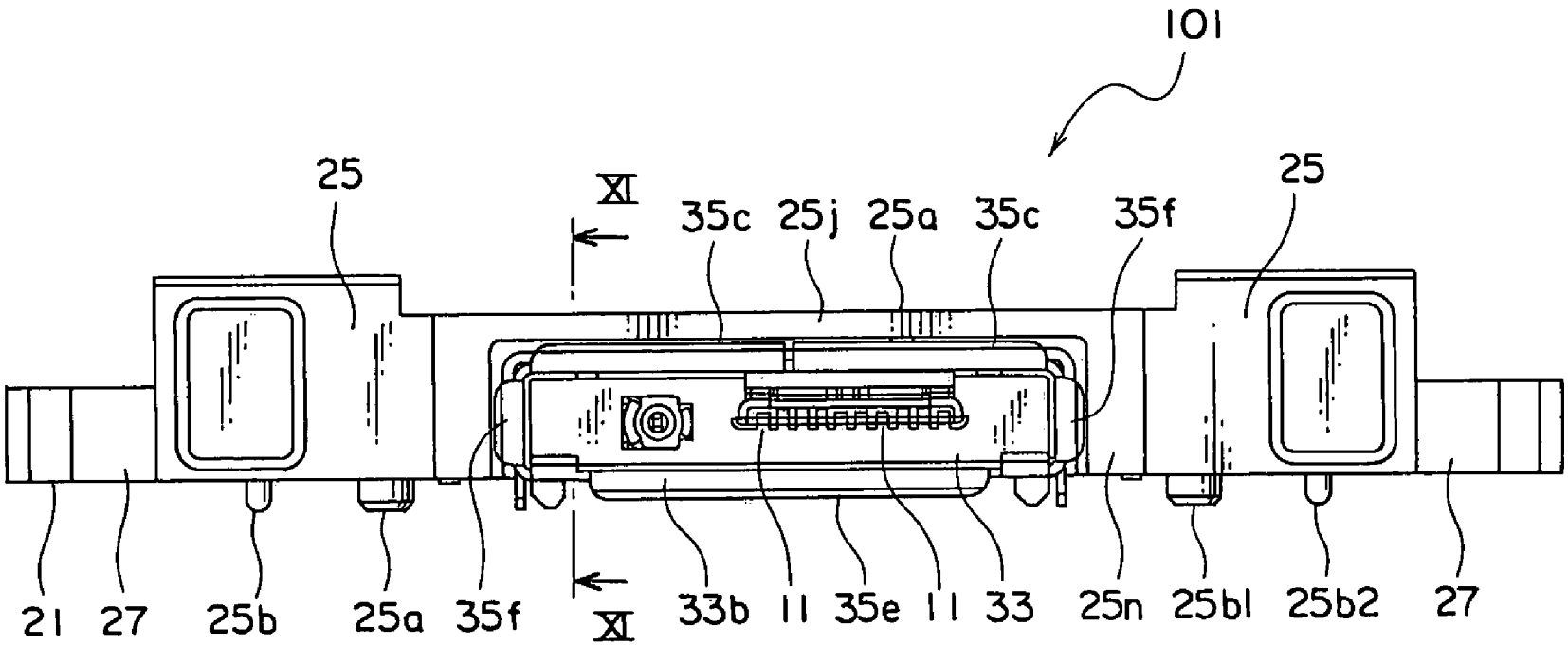
FIG. 10 is a front view of the electric connector illustrated in FIG. 9.
Figure 11:
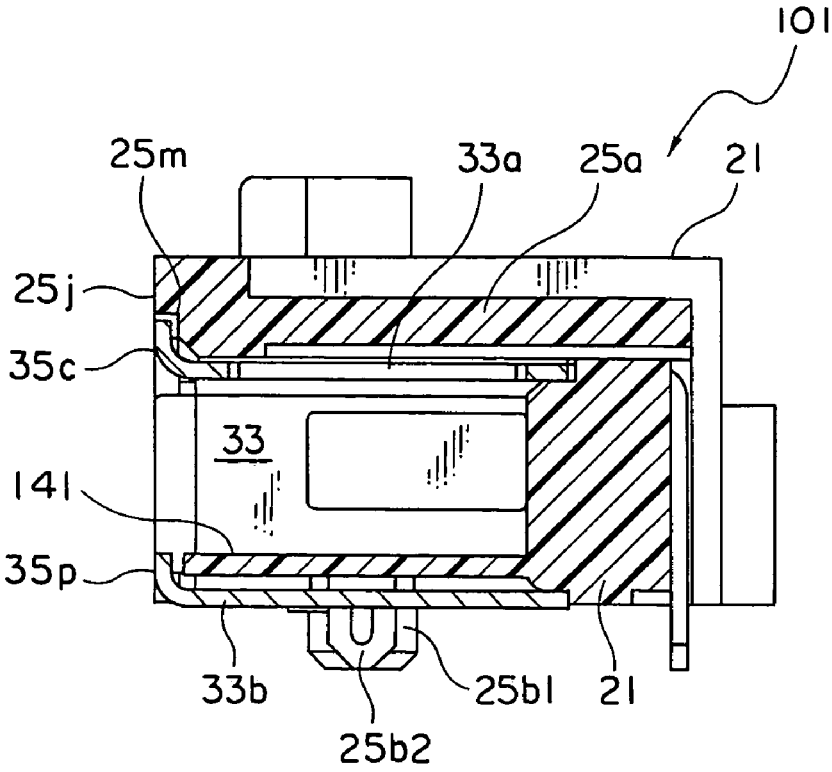
FIG. 11 is an enlarged sectional view taken along a line XI—XI in FIG. 10.
Figure 12:
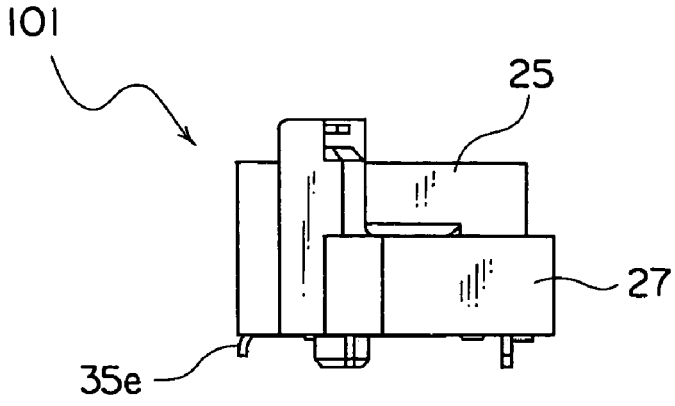
FIG. 12 is a right side view of the electric connector illustrated in FIG. 9.
Figure 13:
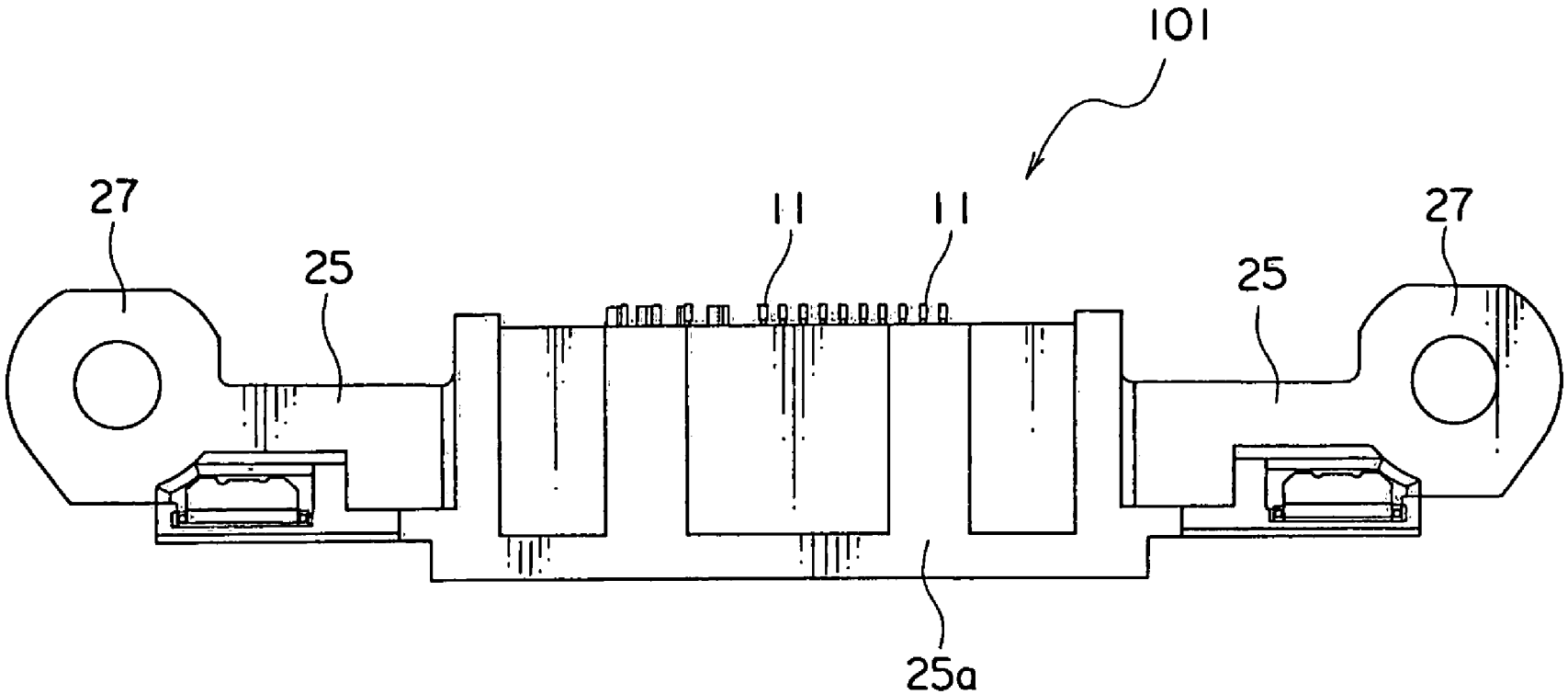
FIG. 13 is a plan view of the electric connector illustrated in FIG. 9.
Figure 14:
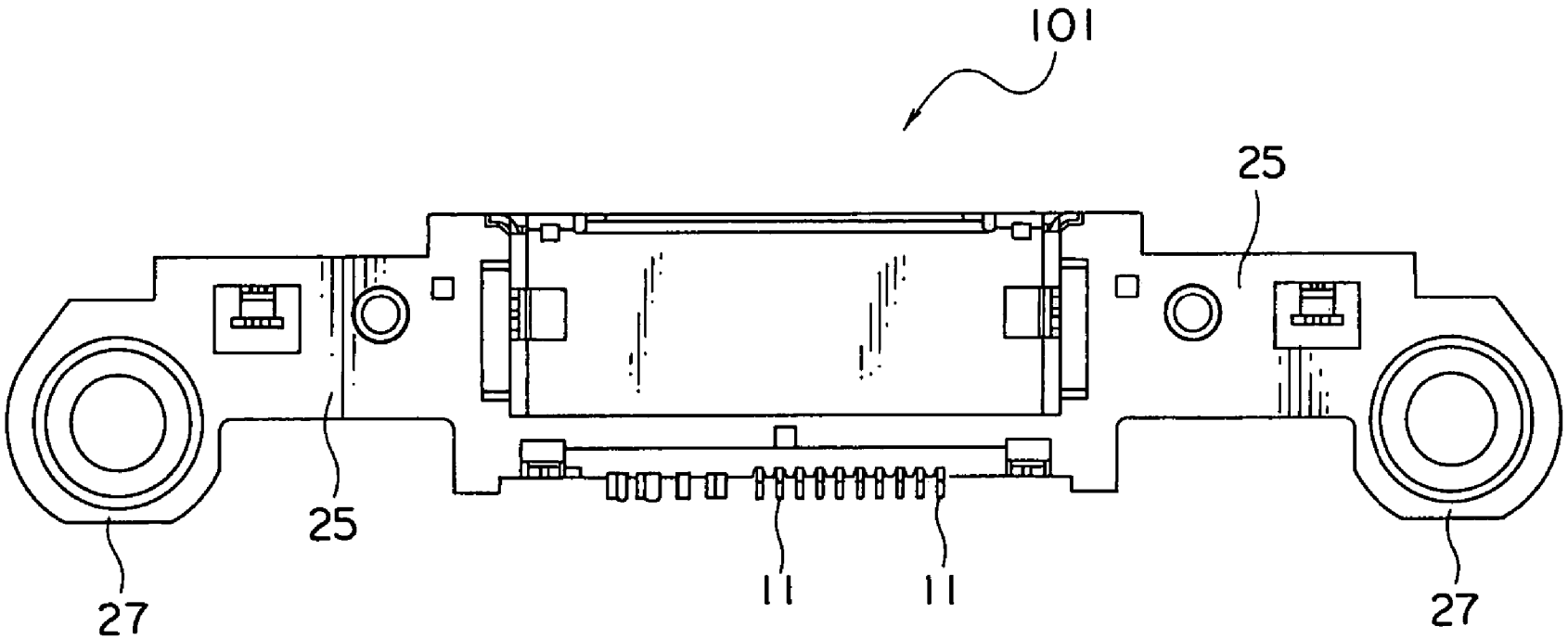
FIG. 14 is a bottom view of the electric connector illustrated in FIG. 9.

As shown in FIGS. 7 and 8 also, the shell 31 further has a pair of bent portions 35*p* formed at a fitting-side end of the second shell plate portion 33*b* on longitudinal opposite sides of the second guide portion 35*e* and bent in a direction reverse to the second guide portion 35*e*.

Each of the receiving portions 41 is made of a metal material and has a band-like flat plate portion 41*a* and a locking portion 41*b* formed at a fitting-side end of the flat plate portion 41*a* and slightly bent. The locking portion 41*b* is engaged with a locking hole 35*s* formed on each of the bent portions 35*p*. The flat plate portion 41*a* extends from the fitting-side end to a rear end which is press-fitted to the housing 21 to be fixed. Each of the receiving portions 41 may be made of a resin material.

Each of the block portions 25 has a pair of pin portions 25*b*1 and 25*b*2 formed on its bottom surface and extending outward therefrom to be inserted to a substrate (not shown). The shell fitting portion 33 of the shell 31 is fitted to a mating fitting portion of a mating connector (not shown). When the mating connector is fitted into the shell fitting portion 33, the receiving portions 41 serve as key plates for receiving a load by prying force.

In the electric connector 1, the prying force exerted when the electric connector 1 is fitted to the mating connector is received by the receiving portions 41. Therefore, it is possible to prevent the shell from being deformed by the prying force.

In addition, the shell fitting portion 33 is defined by the shell 31 and the receiving portions 41. This results in increasing mechanical strength of the shell fitting portion 33. Therefore, stable contact is established between the shell 31 and a mating shell of the mating connector.

Referring to FIGS. 9 to 14, description will be made of an electric connector according to a second embodiment of this invention. Similar parts similar to those of the first embodiment are designated by like reference numerals and description thereof will be omitted.

In FIGS. 9 to 14, the electric connector depicted by a reference numeral 101 comprises a plurality of conductive contacts 11, an insulating housing 21 holding the contacts 11, a conductive shell 31, and a pair of receiving portions 141 integrally formed with the housing 21. The housing 21 has a holding portion 23 holding the shell 31, a pair of block portions 25 extending from opposite sides of the holding portion 23 in a longitudinal direction of the electric connector 1, respectively, and a pair of fixing portions 27 extending from the block portions 25 in the longitudinal direction, respectively.

The holding portion 23 has a main plate portion 25*a* extending long in the longitudinal direction of the electric connector 1 and a pair of wall portions 25*c* connected to longitudinal opposite ends of the main plate portion 25*a*, respectively, and faced to each other. The shell 31 has a generally flat and tubular or hollow shell fitting portion 33 which is disposed in a space surrounded by the main plate portion 25*a* and the wall portions 25*c* and which is held by the housing 21. The shell fitting portion 33 has a first shell plate portion 33*a* faced to an inner surface of the main plate portion 25*a*, a second shell plate portion 33*b* faced to and spaced from the first shell plate portion 33*a* generally in parallel thereto, and a pair of shell side plate portions 33*c* connected to longitudinal opposite ends of the first and the second shell plate portions 33*c*.

The shell 31 has a first guide portion 35*c* bent from a fitting-side or front opening end of the first shell plate portion 33*a* to face a recess 25*m* formed on an end face 25*j* of the main plate portion 25*a* of the holding portion 23, a second guide portion 35*e* bent outward from a fitting-side opening end of the second shell plate portion 33*b*, and a pair of third guide portions 35*f* bent outward to face the wall portions 25*c* of the holding portion 23, respectively.

Figure 15:
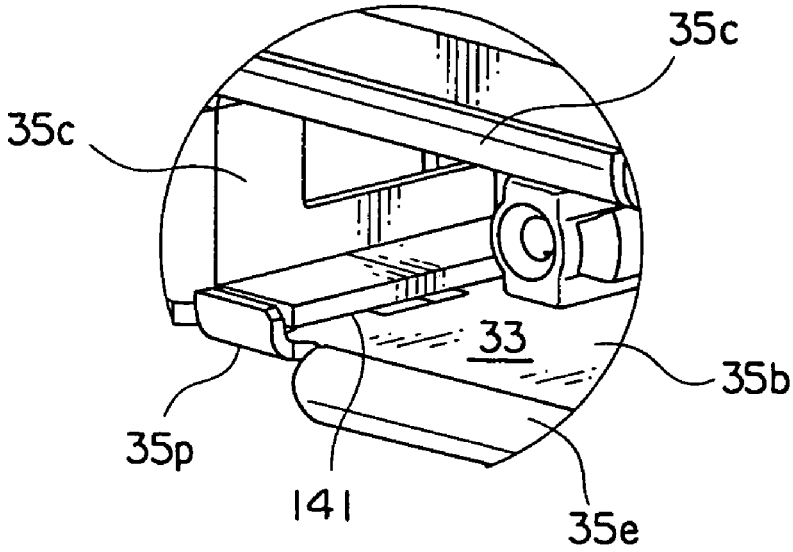
FIG. 15 is an enlarged view of a characteristic part in FIG. 9.
Figure 16:
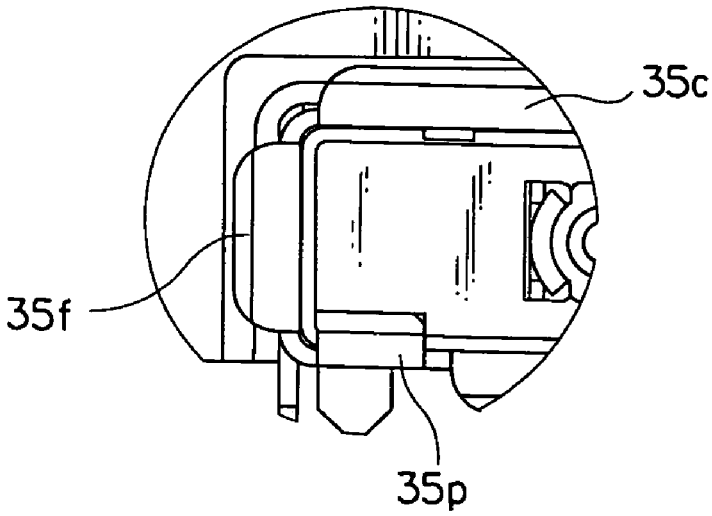
FIG. 16 is an enlarged view of a characteristic part in FIG. 10.
Figure 17:
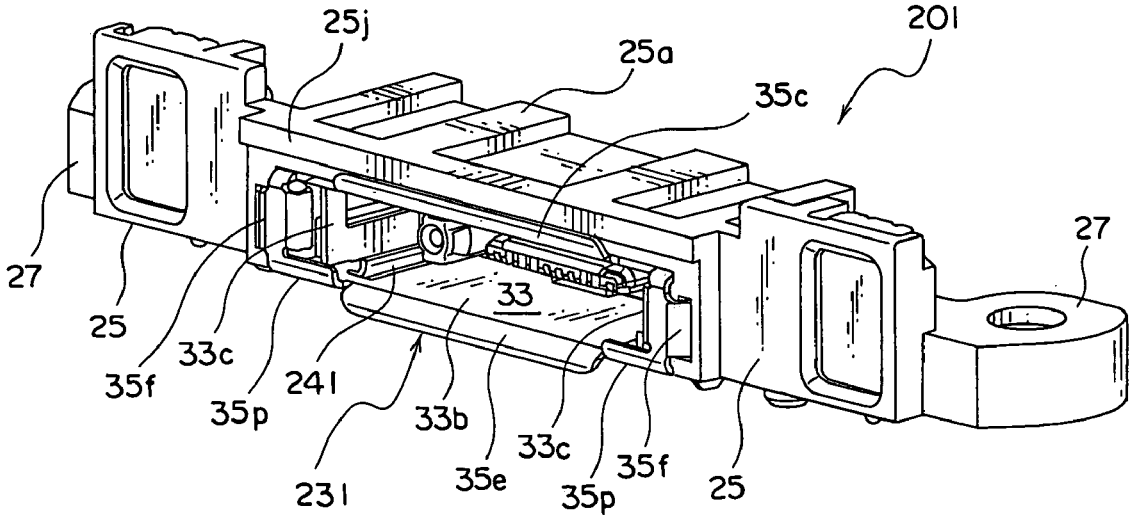
FIG. 17 is a perspective view of an electric connector according to a third embodiment of this invention.
Figure 18:
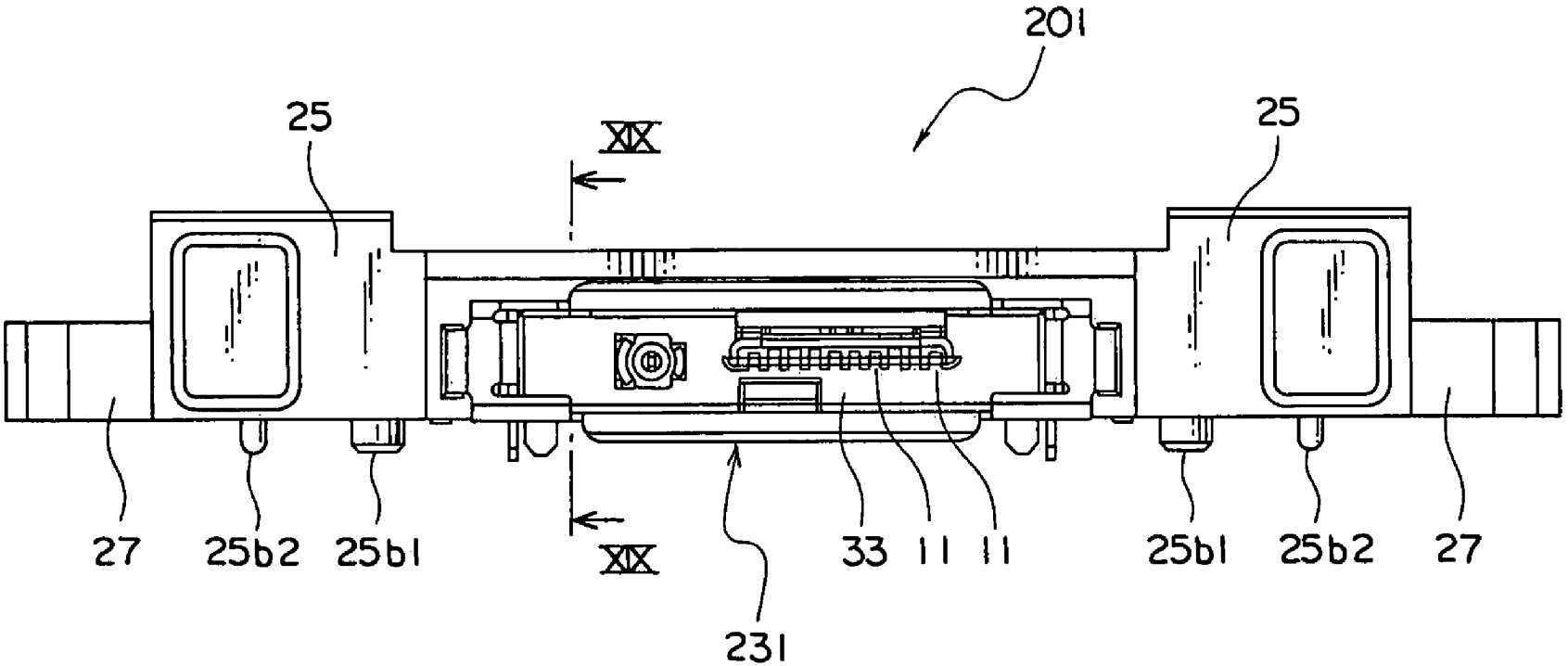
FIG. 18 is a front view of the electric connector illustrated in FIG. 17.
Figure 19:
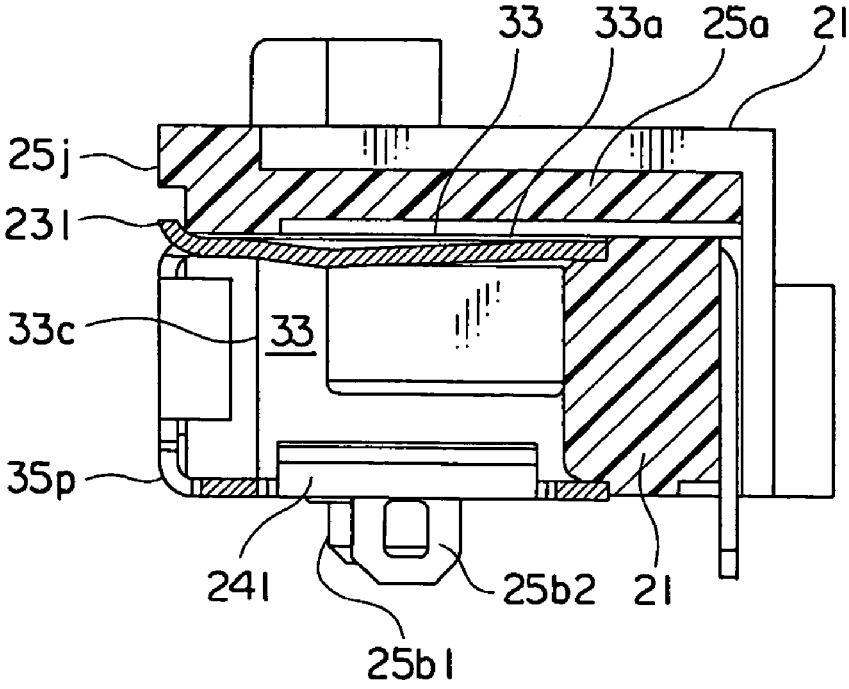
FIG. 19 is a sectional view taken along a line XIX—XIX in FIG. 18.
Figure 20:
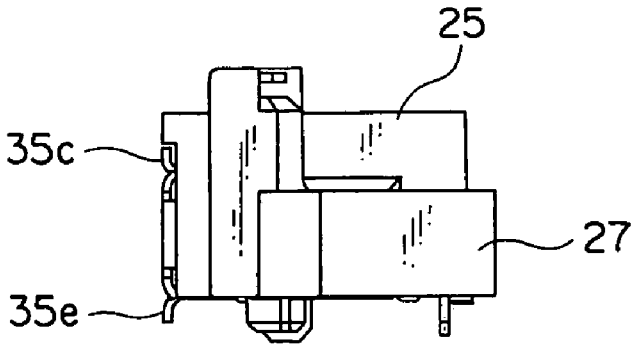
FIG. 20 is a right side view of the electric connector illustrated in FIG. 17.
Figure 21:
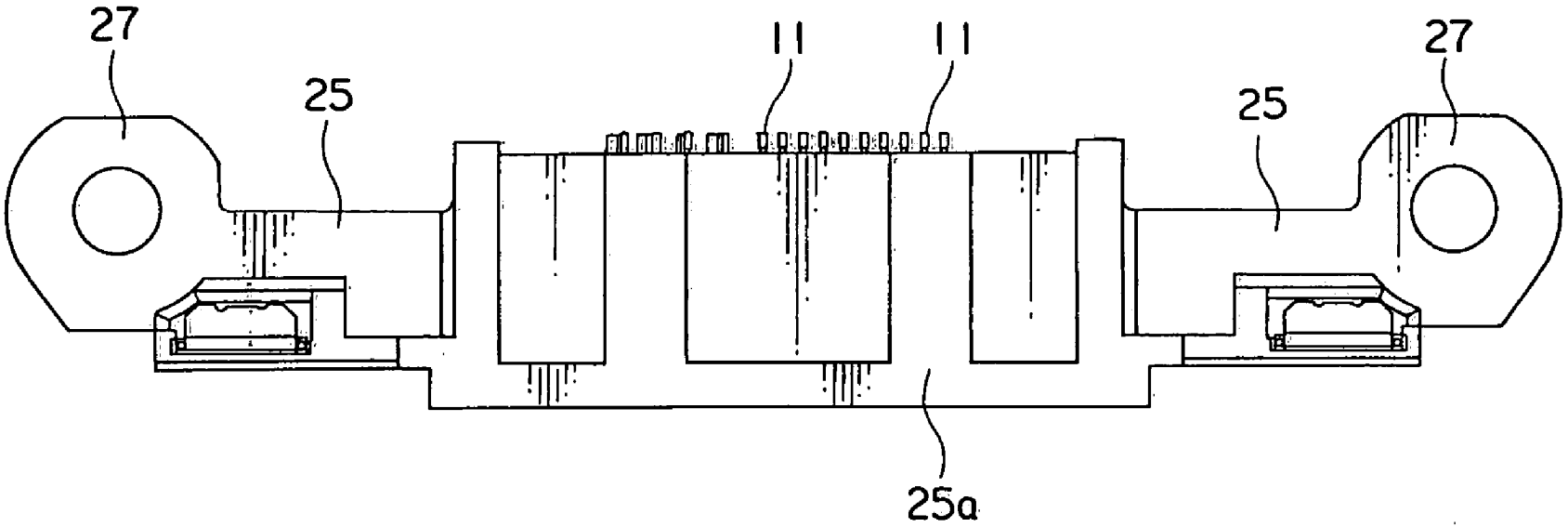
FIG. 21 is a plan view of the electric connector illustrated in FIG. 17.
Figure 22:
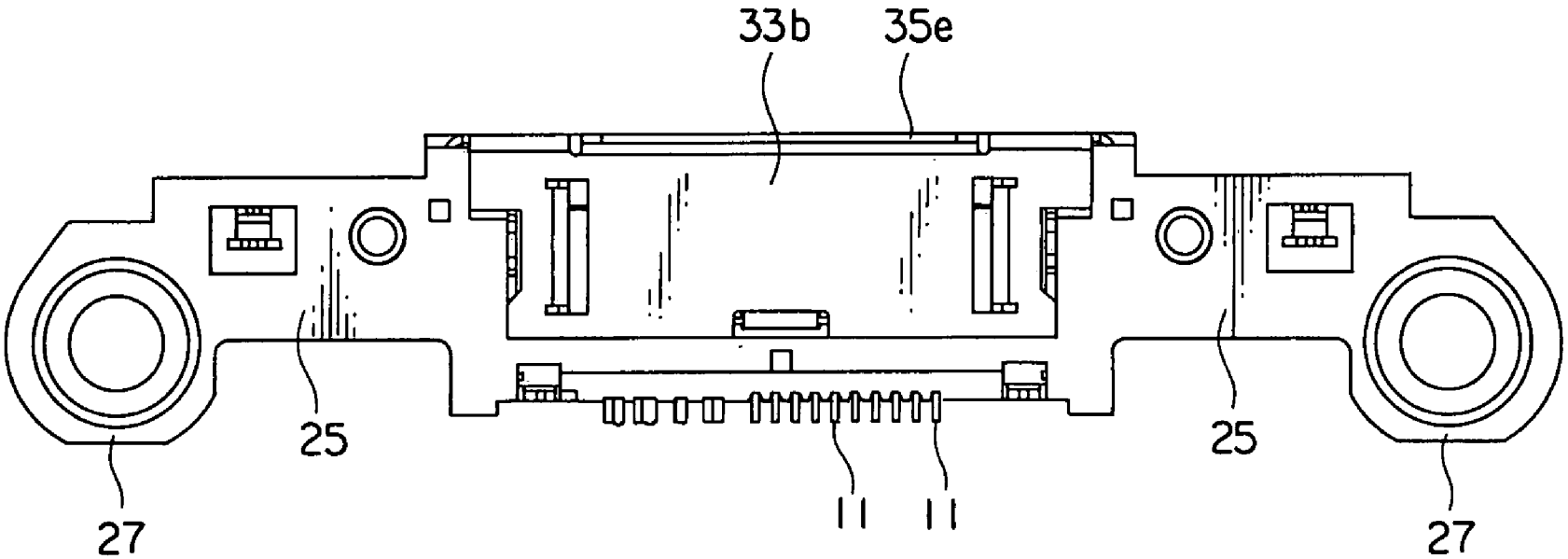
FIG. 22 is a bottom view of the electric connector illustrated in FIG. 17.

As shown in FIGS. 15 and 16 also, each of the receiving portions 141 is made of a resin material and is integrally formed with the housing 21 by molding. The shell fitting portion 33 of the shell 31 is fitted to a mating fitting portion of a mating connector (not shown). When the mating connector is fitted into the shell fitting portion 33, the receiving portions 141 serve as key plates for receiving a load by prying force.

In the electric connector 101, the prying force exerted when the electric connector 101 is fitted to the mating connector is received by the receiving portions 141. Therefore, it is possible to prevent the shell from being deformed by the prying force.

In addition, the shell fitting portion 33 is defined by the shell 31 and the receiving portions 141. This results in increasing mechanical strength of the shell fitting portion 33. Therefore, stable contact is established between the shell 31 and a mating shell of the mating connector.

Referring to FIGS. 17 to 22, description will be made of an electric connector according to a third embodiment of this invention. Similar parts similar to those of the first embodiment are designated by like reference numerals and description thereof will be omitted.

In FIGS. 17 to 22, the electric connector is depicted by a reference numeral 201. A shell 231 has a generally flat and tubular or hollow shell fitting portion 33 which is disposed in a space surrounded by a main plate portion 25*a* and a pair of wall portions 25*c* of a holding portion 23 and which is held by a housing 21. The shell fitting portion 33 has a first shell plate portion 33*a* faced to an inner surface of the main plate portion 25*a*, a second shell plate portion 33*b* faced to and spaced from the first shell plate portion 33*a* generally in parallel thereto, and a pair of shell side plate portions 33*c* connected to longitudinal opposite ends of the first and the second shell plate portions 33*c*.

The shell 231 has a first guide portion 35*c* bent from a fitting-side or front opening end of the first shell plate portion 33*a* to face a recess 25*m* formed on an end face 25*j* of the main plate portion 25*a* of the holding portion 23, a second guide portion 35*e* bent outward from a fitting-side opening end of the second shell plate portion 33*b*, and a pair of third guide portions 35*f* bent outward to face the wall portions 25*c* of the holding portion 23, respectively.

Figure 23:
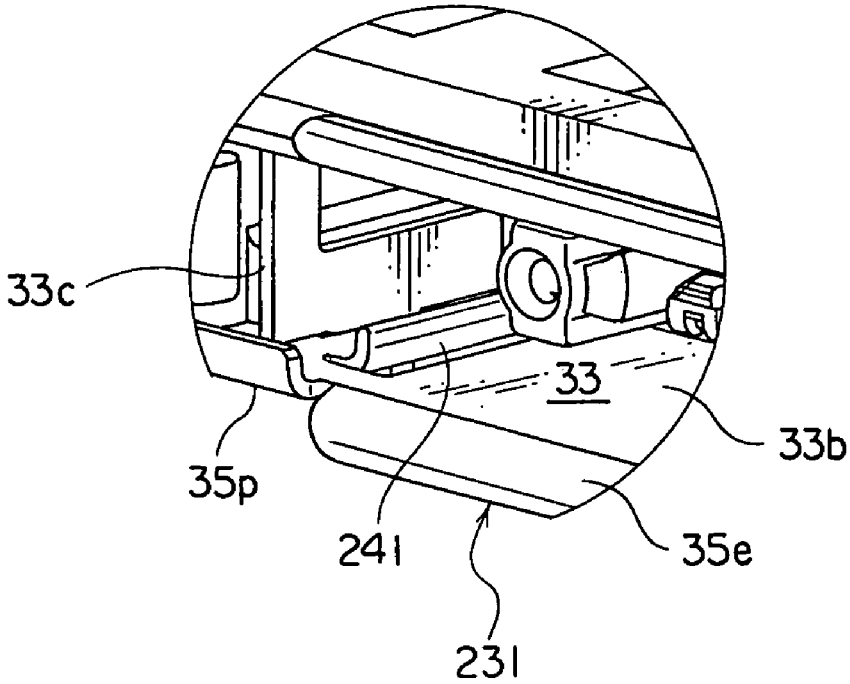
FIG. 23 is an enlarged view of a characteristic part in FIG. 17.
Figure 24:
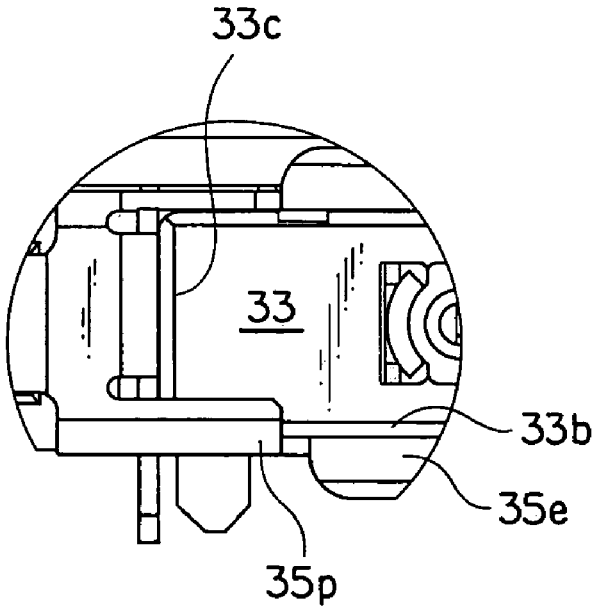
FIG. 24 is an enlarged view of a characteristic part in FIG. 18.

A pair of receiving portions 141 are made of a metal material same as that of the shell 31 and is integrally formed with the shell 23. As shown in FIGS. 23 and 24 also, each of the receiving portions 241 is formed by cutting and raising a part of the second shell plate portion 33*b* into the shell fitting portion 33.

The shell fitting portion 33 of the shell 31 is fitted to a mating fitting portion of a mating connector (not shown). When the mating connector is fitted into the shell fitting portion 33, the receiving portions 241 serve as key plates for receiving a load by prying force.

In the electric connector 201, the prying force exerted when the electric connector 201 is fitted to the mating connector is received by the receiving portions 141. Therefore, it is possible to prevent the shell from being deformed by the prying force.

In addition, the shell fitting portion 33 is defined by the shell 231 and the receiving portions 141. This results in increasing mechanical strength of the shell fitting portion 33. Therefore, stable contact is established between the shell 231 and a mating shell of the mating connector.

Each of the above-mentioned electric connectors may be used as a connector for various apparatuses such as a mobile telephone terminal and a small-sized information terminal.

Although this invention has been described in conjunction with a few preferred embodiments thereof, this invention may be modified in various other manners. In the illustrated examples, the electric connector is provided with a plurality of contacts. However, it will readily be understood that the electric connector may be provided with only one contact.

What is claimed is:

1. An electric connector comprising:

a conductive shell fitting portion to be fitted to a mating connector in a fitting direction, the shell fitting portion including a first shell plate portion and a second shell plate portion facing the first shell plate portion substantially in parallel thereto and spaced therefrom;

a receiving portion placed between the first and second shell plate portions within the shell fitting portion to receive a load by applying force between the electric connector and the mating connector;

a housing coupled to the shell fitting portion; and a conductive contact held by the housing, the receiving portion having a flat shape with one end in the fitting direction coupled to the housing and another end in the fitting direction coupled to the shell fitting portion, the second shell plate portion including a bent portion bent to protect the other end of the receiving portion;

the electric connector being effective prevented from being deformed when the electric connector is fitted to a mating connector.

2. The electric connector according to claim 1, wherein the one end of the receiving portion is fixed to the housing and the other end of the receiving portion is engaged with the shell fitting portion.

3. The electric connector according to claim 1, wherein the receiving portion is integrally formed with the housing.

4. The electric connector according to claim 1, wherein the receiving portion is integrally formed with the shell fitting portion.

5. The electric connector according to claim 1, wherein the receiving portion is made of a metal material.

6. The electric connector according to claim 1, wherein the receiving portion is made of a resin material.

7. The electric connector according to claim 1, wherein the housing has:

a holding portion holding the shell fitting portion;

a block portion extending from the holding portion; and a fixing portion extending from the block portion, the fixing portion being a part to fix the electric connector.

8. The electric connector according to claim 7, wherein the holding portion includes:

a main plate portion; and a pair of wall portions connected to the main plate portion and faced to each other, the shell fitting portion being disposed in a space surrounded by the main plate portion and the wall portions.

9. The electric connector according to claim 8, wherein the first shell plate portion faces the main plate portion;

the shell fitting portion further including a pair of shell side plate portions connected to opposite ends of the first and the second shell plate portions.

10. The electric connector according to claim 9, wherein the shell fitting portion is formed as a part of a conductive shell, the shell including:

a first guide portion extending from the first shell plate portion;

a second guide portion extending from the second shell plate portion; and a third guide portion extending to face the wall portions.

* * * * *